US005531612A

United States Patent [19]

Goodall et al.

[11] Patent Number: 5,531,612

[45] Date of Patent: Jul. 2, 1996

[54] MULTI-PORT MODULAR JACK ASSEMBLY

[76] Inventors: Roy J. Goodall, 21 Vicar's Close, Enfield, Middlesex, England, EN1 3DN; Richard F. Gandy, 2 Rowlatt Drive, St. Albans, Hertfordshire, England, AL3 4NB

[21] Appl. No.: 345,061

[22] Filed: Nov. 25, 1994

[30] Foreign Application Priority Data

Dec. 14, 1993 [GB] United Kingdom ..... 9325594

[51] Int. Cl.[6] ..... H01R 25/00

[52] U.S. Cl. ..... 439/541.5; 439/701

[58] Field of Search ..... 439/540.1, 701, 439/541.5, 638, 639

[56] References Cited

U.S. PATENT DOCUMENTS

| | | | |
|---|---|---|---|
| 4,220,391 | 9/1980 | Krolak et al. | 339/126 R |
| 5,145,380 | 9/1992 | Holcomb et al. | 439/49 |
| 5,161,997 | 11/1992 | Defibaugh et al. | 439/540.1 |
| 5,167,530 | 12/1992 | Wallgren et al. | 439/540 |
| 5,417,585 | 5/1995 | Morin et al. | 439/541.5 |

FOREIGN PATENT DOCUMENTS

WO87/07444 3/1987 WIPO .

OTHER PUBLICATIONS

AMP Catalog 82066, Streamlined 8–92, *Multi–Port Modular Jacks,* AMP Incorporated, Harrisburg, PA 17105, p. 9.

*Primary Examiner*—Gary F. Paumen

*Attorney, Agent, or Firm*—Eric J. Groen; Driscoll A. Nina

[57] ABSTRACT

A modular jack assembly for mounting to a printed circuit board, is shown comprising a plurality of modular jacks assembled to a common integral housing and disposed in back-to-back mirror image symmetry. Shielding, is provided around the connector assembly and shielding between the two rows is also provided for suppressing cross-talk therebetween. The design is compact, providing for a large number of ports without increasing the length of the connector assembly, whilst also providing good access to the resilient locking latches of complementary modular plugs received by the jacks.

11 Claims, 8 Drawing Sheets

MULTI-PORT MODULAR JACK ASSEMBLY

BACKGROUND OF THE INVENTION

1. Field of the Invention

This invention relates to a multi-port modular jack assembly for mounting on a printed circuit board for high speed data transmission.

2. Description of the Prior Art

It is quite common to use modular jacks for the transmission of digital data, whereby some computing equipment is accessed by a plurality of devices and therefore has a plurality of modular jacks. In order to reduce the cost and space requirements, these modular jacks have been integrated in a single housing in a juxtaposed manner for mounting onto a PC board as shown in FIG. 1. Due to the high data transmission speed of many computers today, such multi-port modular jacks are also provided with shielding around the external surface of the integral housing. It is also an advantage to have a large number of modular jacks mounted to the edge of a same printed circuit board, however increasing the number of parts would lengthen the connector assembly in the prior art solution shown in FIG. 1, as the modular jacks are arranged in a single row. The connector assembly length however is limited by the external size of the computer and the length of the printed circuit board to which it is mounted. It would therefore be desirable to increase the number of ports without increasing the length of the connector. In doing so, one should ensure that the resilient latches of the modular plugs that connect with the jacks are easily accessible in order to easily release the plug from the jack. Certain data transmission standards such as 10 Base T, require connector assemblies to function reliably for very high data transmission speeds and also high voltages. High data transmission speeds e.g. 100 Mhz require effective shielding, and high voltages mean that the signal contacts should be sufficiently spaced from the grounding circuits in order to avoid flashover.

SUMMARY OF THE INVENTION

It is therefore an object of this invention to provide a multi-port modular jack assembly for mounting on a printed circuit board, with an increased number of ports without increasing the length of the assembly.

It is a further object of this invention to provide a multi-port modular jack assembly for mounting on a printed circuit board that is able to function reliably with systems operating under high data transmission rates and high voltages, e.g. according to the 10 Base T standard.

It is a further object of this invention to provide a compact and relatively inexpensive modular jack assembly with good access for latching and unlatching of complementary modular plugs for connection therewith.

The objects of this invention have been achieved by providing a modular jack connector assembly for mounting on a printed circuit board (PCB), having a common main housing within which a plurality of receptacle connectors are mounted having plug receiving portions and printed circuit board mounting portions bent at approximately 90° therefrom, the assembly characterized in that the receptacle connectors are arranged in an upper row and a lower row in a substantially mirror image disposition, the rows substantially parallel to the printed circuit board, whereby an electrically conductive intermediate shielding plate may be positioned between the rows for suppressing cross-talk therebetween.

DETAILED DESCRIPTION OF THE PREFERRED EMBODIMENT

Figure 1:
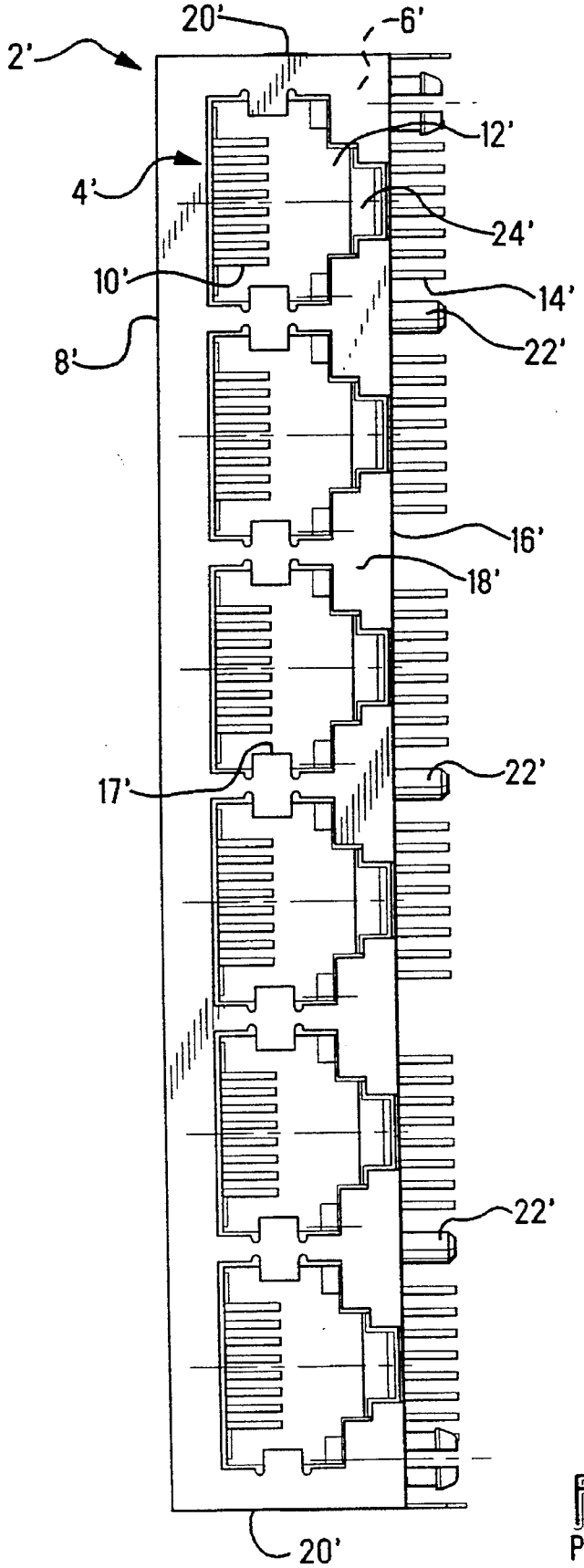
FIG. 1 PRIOR ART
FIG. 1 is a single row multi-port modular jack assembly of the prior art.

Referring first to FIG. 1, a prior art modular jack assembly is shown at 2' comprising a single row of juxtaposed modular jacks 4' mounted in an integral main housing 6' enclosed in a shielding member 8'. The modular jacks 4' comprise a plurality of juxtaposed flexible spring wire contacts 10' for making electrical contact with a complementary modular jack inserted into a plug receiving portion 12' of the modular jack 4', whereby the contacts 10' are integrally linked to printed circuit board pin portions 14' extending below a bottom surface 16' of the connector assembly 2'. The outer shielding member 8' comprises cutouts 17' on a front face 18' for allowing passage of the modular plug into the receiving portions 12'. The shield member 8' has grounding tabs projecting below the bottom surface 16' at longitudinal ends 20' of the connector 2', both the pins 14' and grounding tabs 22' being received in corresponding plated through holes of a printed circuit board (PCB) for electrical connection therewith.

The modular jacks 4' further comprise a latching protrusion 24' cooperable with resilient latching arms of the complementary modular plug for securely locking the modular plug thereto. The modular plug is disconnected from the modular jack 4' by elastically biasing the latching arm thereof inwards and pulling the plug out. The front face 18' of the connector assembly 2' is positioned proximate an outer surface of a computer within which the printed circuit board is mounted, so that access to the modular jacks 4' is possible from the exterior and the latching means easily accessible by hand.

In order to increase the number of ports 4' in this prior art solution, it would be necessary to lengthen the connector assembly 2' which is limited by the printed circuit board dimensions.

Figure 2:
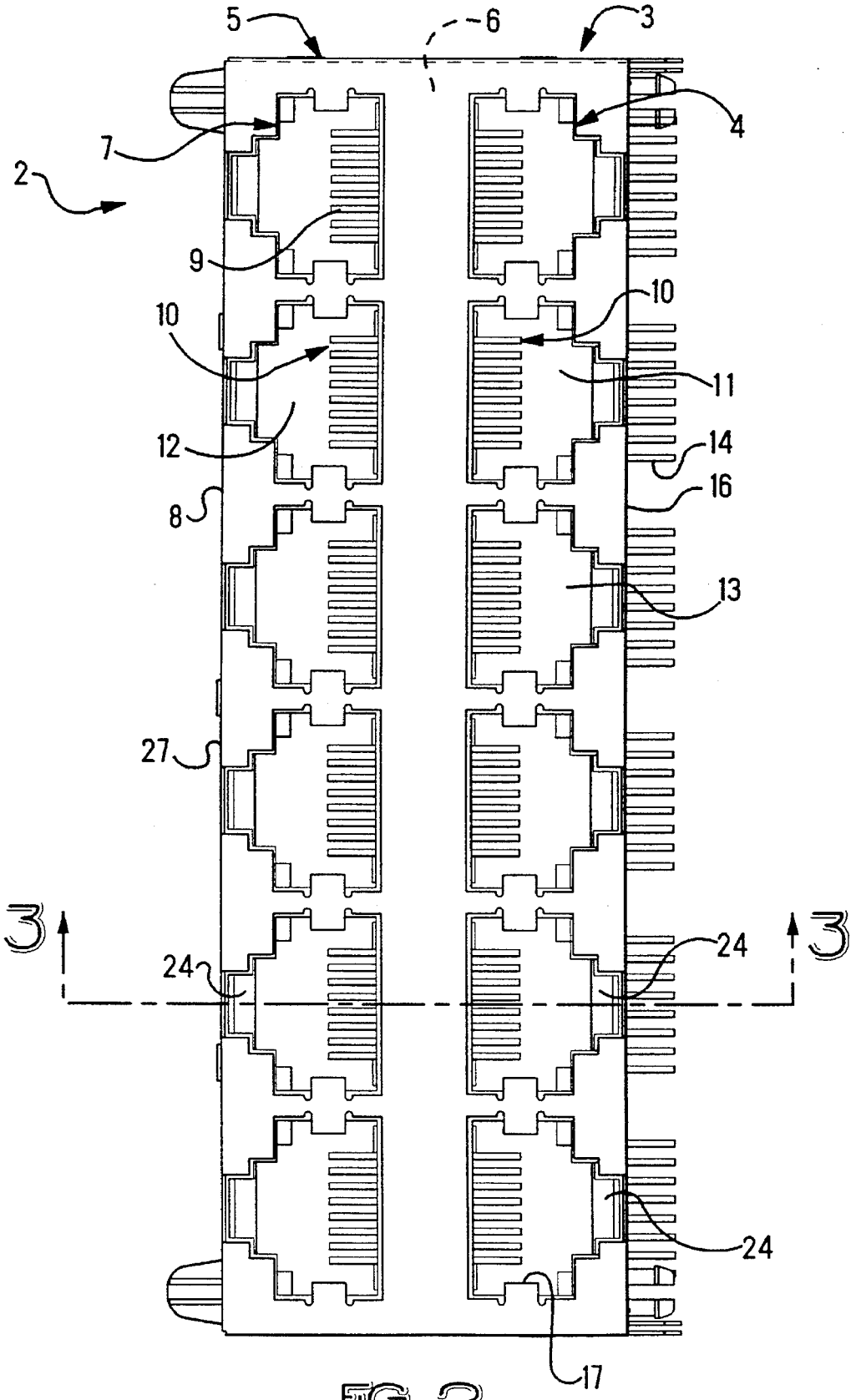
FIG. 2 is a multi-port modular jack assembly for mounting to a printed circuit board, according to the preferred embodiment of this invention.
Figure 3:
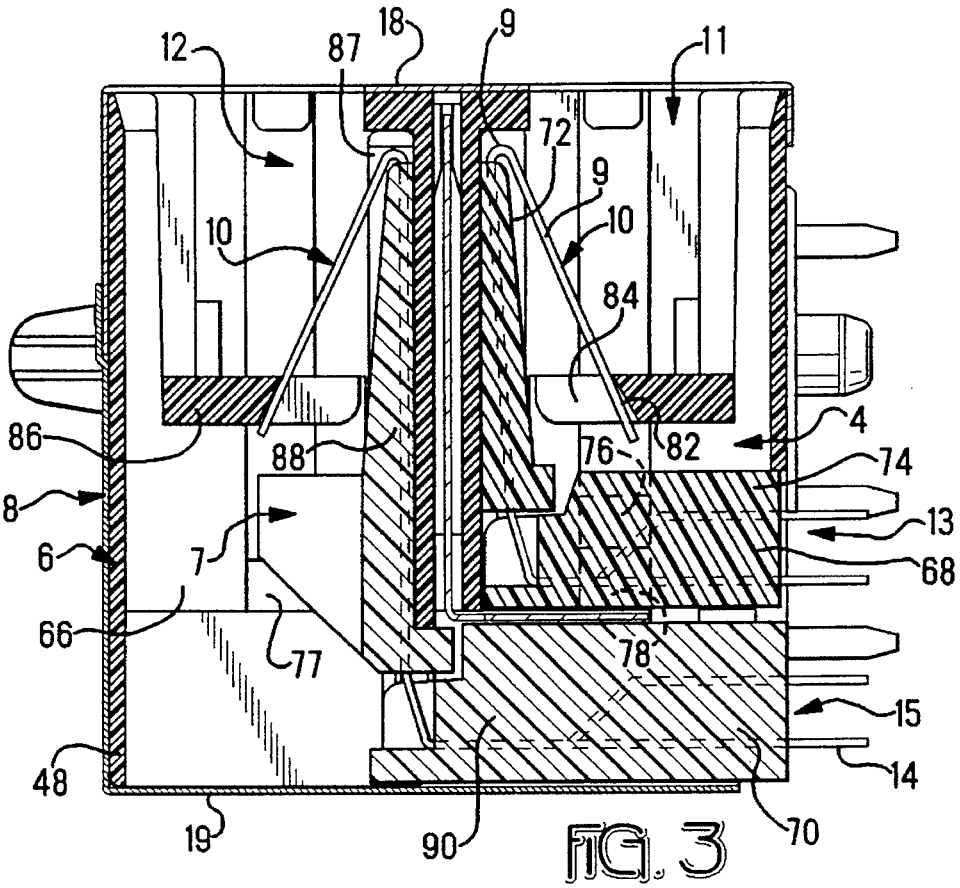
FIG. 3 is a cross-sectional view through lines 3—3 of FIG. 2.
Figure 5:
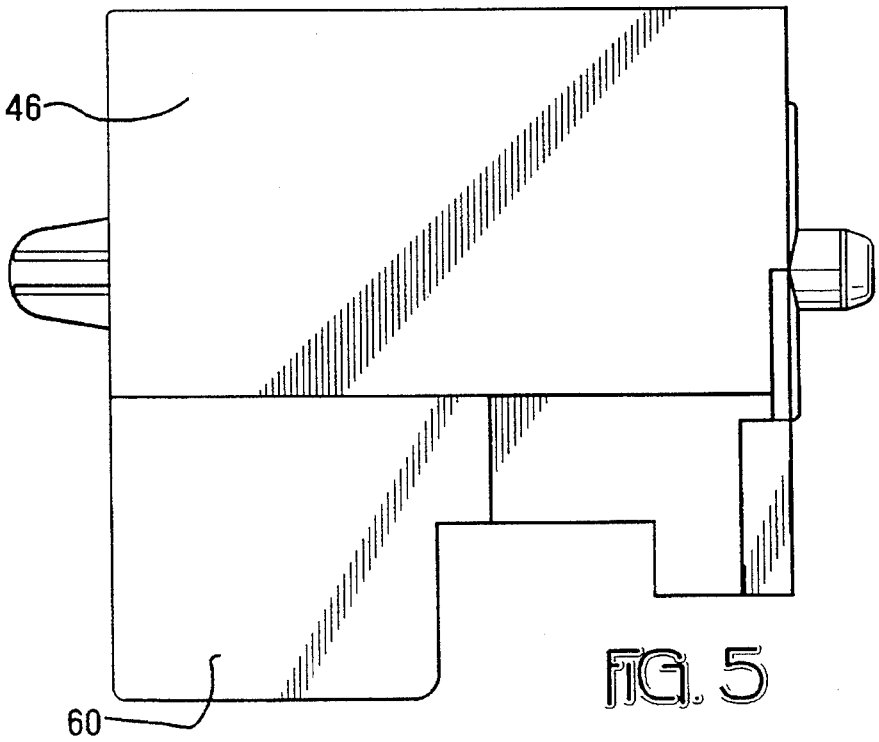
FIG. 5 is a view in the direction of arrow 5 of FIG. 4.
Figure 4:
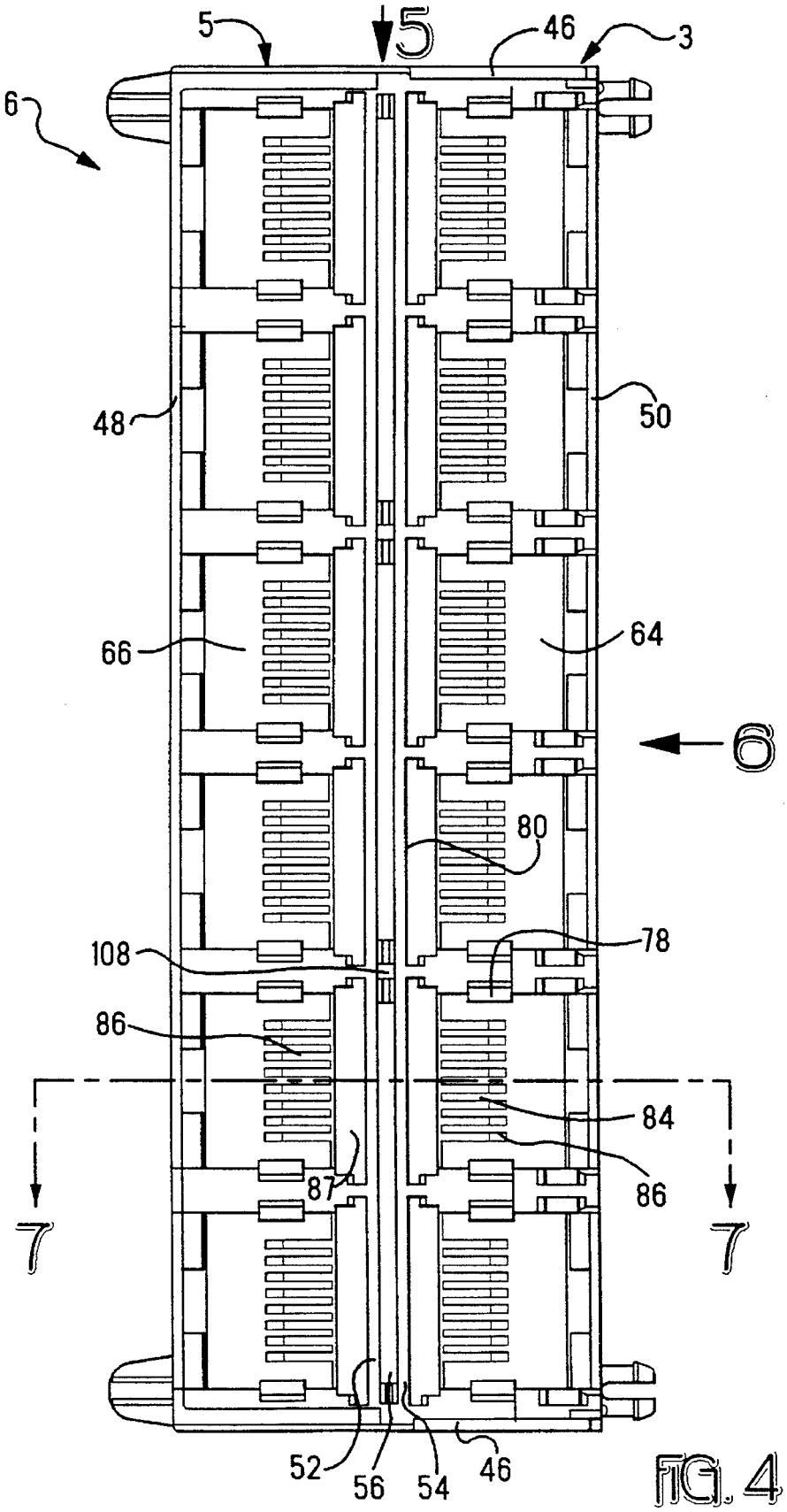
FIG. 4 is a back view of a common housing of the connector assembly.
Figure 6:
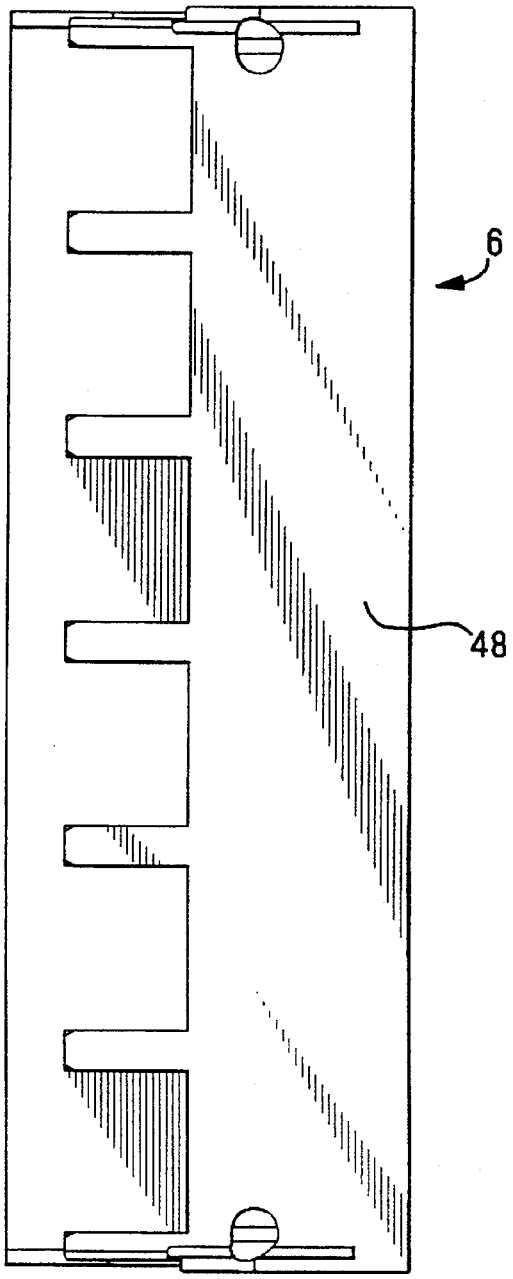
FIG. 6 is a bottom view in the direction of the arrow 6 of FIG. 4.

Referring now to FIGS. 2 and 3, the preferred embodiment of this invention is shown as a modular jack connector assembly 2 comprising a first row 3 of modular jacks 4 and a second row 5 of modular jacks 7 mounted within a common main housing 6 surrounded by external shielding 8. The modular jacks 4, 7 have a plurality of juxtaposed resilient spring wire contacts 10 for interconnecting a complementary modular plug to the PCB, the contacts 10 comprising, plug contact portions 9 connected to PCB contact portions 14 extending below a lower mounting surface 16 of the connector assembly 2. The modular jacks 4, 7 have plug receiving sections 11, 12 and PCB mounting sections 13, 15 respectively, the plug receiving sections 11, 12 comprising cavities profiled to receive the complementary modular plugs.

Figure 8:
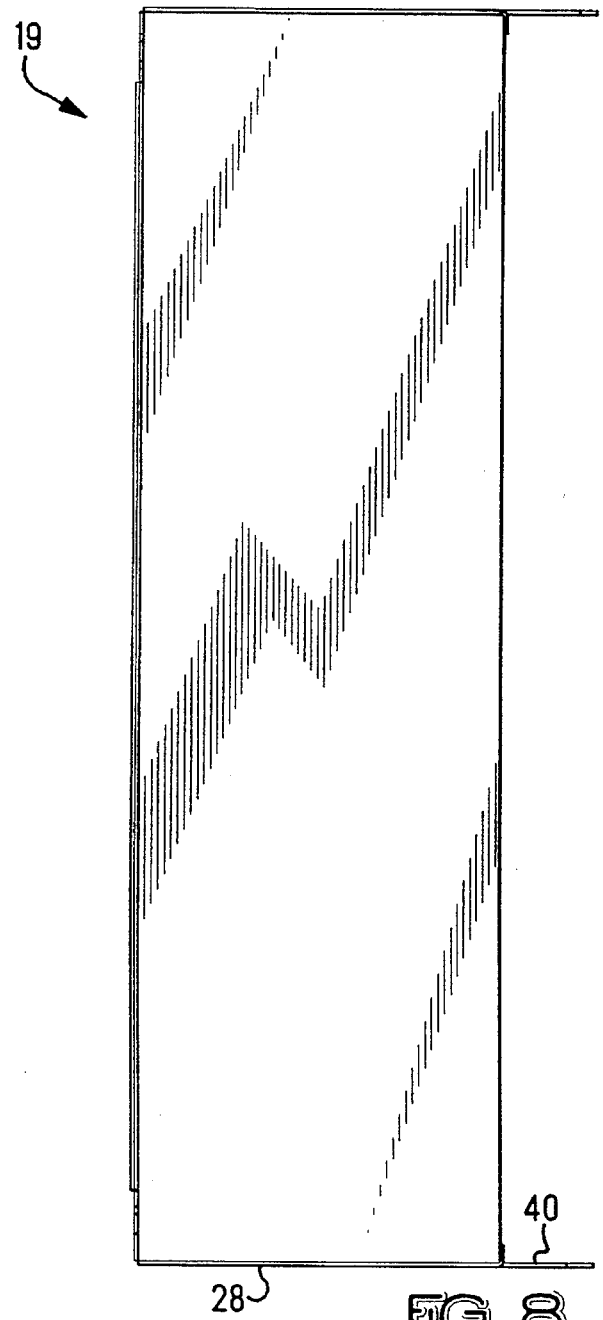
FIGS. 8, 9 and 10 are respectively front, bottom and side views of a rear shield member mountable over the rear of the main housing shown in FIGS. 4–7.
Figure 9:
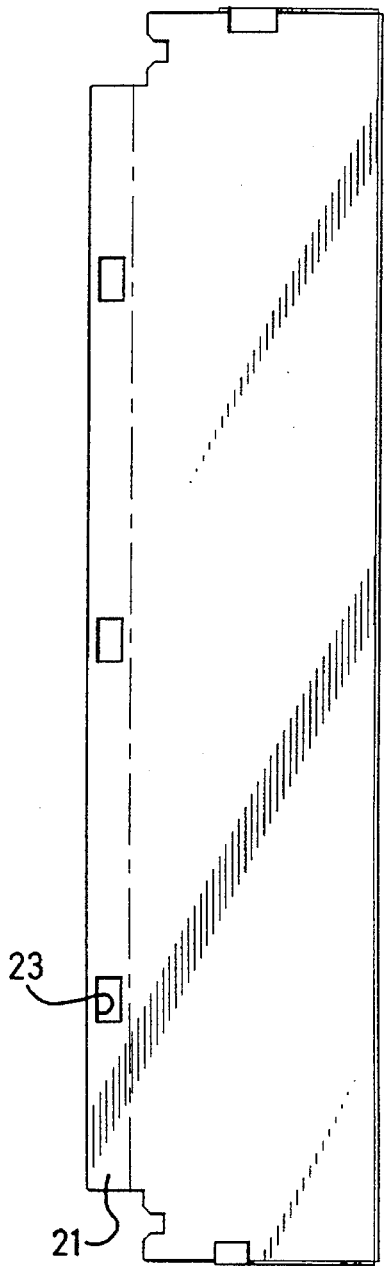
Figure 10:
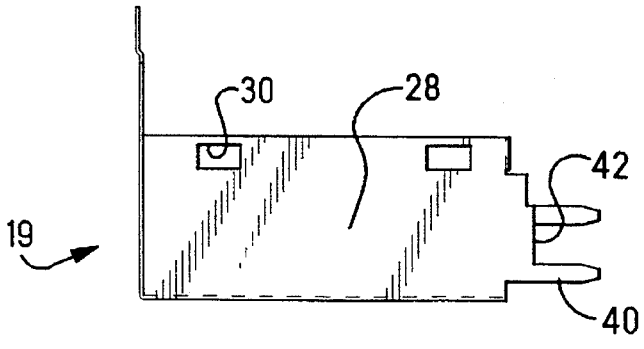
Figures 11, 12, 13, 14, 15:
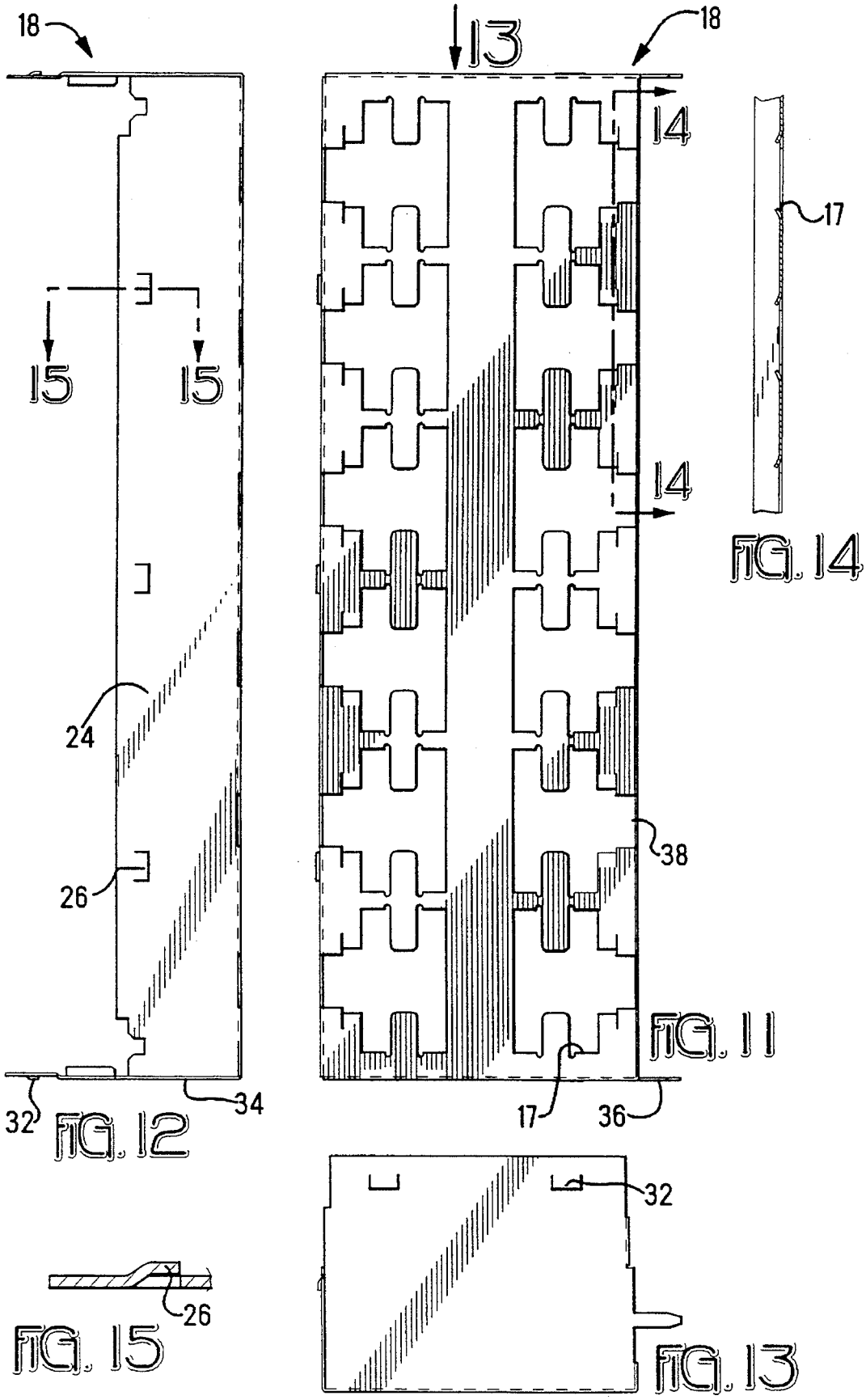
FIGS. 11, 12 and 13 are respectively front, bottom and side views of a front shield member mountable over the front of the main housing as shown in FIGS. 4–7.
FIG. 14 is a partial cross-sectional view through lines 14—14 of FIG. 11.
FIG. 15 is a partial cross-sectional view through lines 15—15 of FIG. 12.
Figure 16:
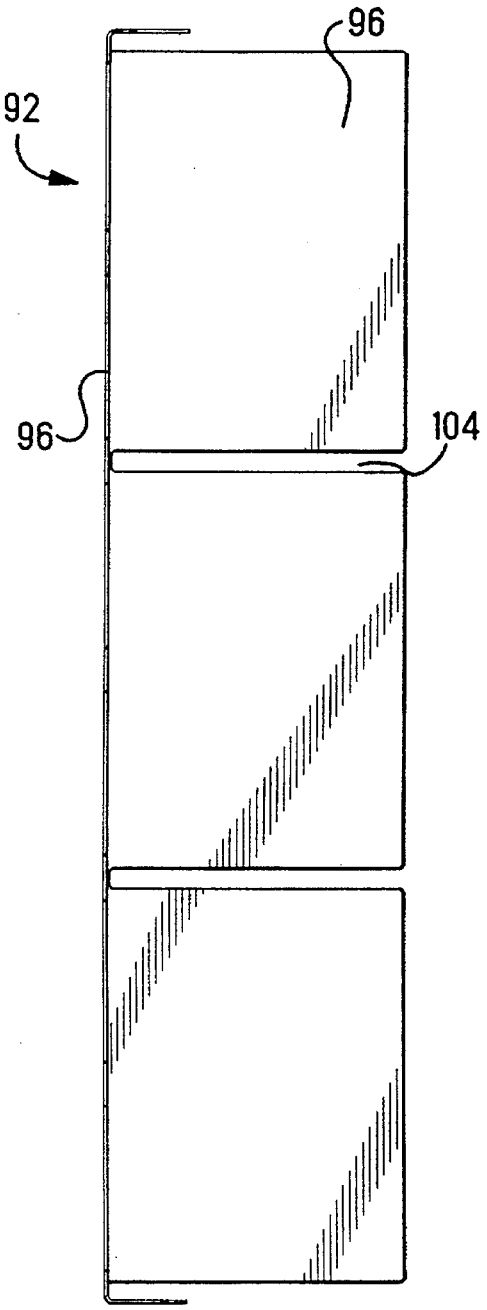
FIGS. 16–18 are respectively bottom, front and side views of a mid shielding member for mounting within the main housing as shown in FIGS. 4–7.
Figure 17:
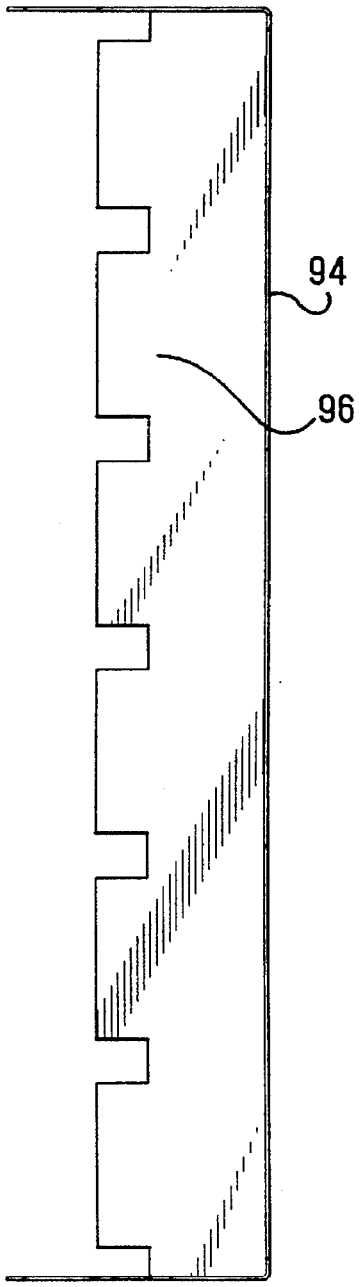
Figure 18:
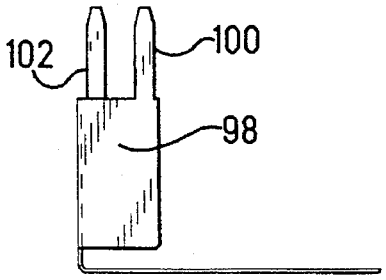

The external shielding 8 comprises a front shield member 18 (see FIGS. 11–15) stamped and formed from sheet metal, comprising a plurality of cutouts 17 allowing passage of the complementary modular plugs into the plug receiving sections 11, 12 of the modular jacks 4, 7, the shielding 8 also comprising a rear shield member 19 (see FIGS. 8–10) having overlapping portions 21 with latching cutouts 23 therein, the portions 21 overlapping a rearward portion 24 of the front shield member 18 which has stamped out tabs 26 that engage in the cavities 23 of the rear shield member in order to interlock the front and rear shield members 18, 19 together. Referring to FIG. 10, side walls 28 of the rear shield member also have window cutouts 30 engageable with projections 32 (see FIG. 12) stamped out of side walls 34 of the front shield member 18, similarly for ensuring mechanical connection between the front and rear shield members. The front shield member 18 comprises grounding tabs 36 projecting from a lower end 38 of the side walls 34, and the rear shielding member 19 likewise has grounding tabs 40 projecting below a lower end 42 of the side walls 28, the grounding tabs 36, 40 receivable in plated through-holes of the PCB for electrical connection to a grounding circuit thereof.

Referring now to FIGS. 3–6, the common main housing 6 is shown as an integrally moulded structure of insulative material comprising external side walls 46 extending between a top wall 48 and a bottom wall 50. Extending between opposed side walls 46 and parallel to the top and bottom walls 48, 50 but disposed centrally therebetween, are a pair of mid-walls 52, 54 separated by a mid-shield receiving slot 56. A first mid-wall 54 and the lower wall 50 bound the lower row 3 of modular jacks, and a second mid-wall 52 and the upper wall 48 bound the upper row 5 of modular jacks 7. The common housing 6 comprises a front face 58 and a rear face 60 between which the top and side walls 48, 46 extend. The mid-walls 52, 54 extend from the front face 58 to a mid-face 62 positioned between the front face 58 and rear face 60. A plurality of lower cavities 64 and upper cavities 66 of the rows 3 and 5 respectively, extend between the front face 58 and the mid-face 62 and are adapted to receive lower modular jack inserts 68 and upper modular jack inserts 70 respectively (see FIG. 3).

The lower inserts 68 are known and already used in the prior art solution shown in FIG. 1, and comprise (see FIG. 3) a first insulative over-moulded portion 72 and a second insulative over-moulded portion 74 that are moulded over the resilient spring wire terminals 10, securely holding them together. The lower inserts 68 are securely mountable into the main housing 6 by cooperation of lateral protrusions 76 (see FIGS. 3 and 4) of the second over-moulded portion 74 with resilient latches 78 integrally attached to the main housing 6 and projecting into the cavities 64, 66 thereof. The first over-moulded portion 72 of the lower insert 68, is received within slots 80 parallel and adjacent the lower mid-wall 54 whereby the individual spring contacts 10 are separated one from the other proximate free ends 82 thereof by a comb portion 84 integral with the housing 6 and positioned with the housing cavities 64, whereby the comb portions 84 have tapered stop surfaces 86 against which the free ends 82 of the spring contacts 10 abut for prestressing thereof. The comb portion 84 serves to guide and correctly position the spring contacts 10, whereby the slot 80 also ensures correct holding and positioning of the contacts 10 by way of guiding the first over-moulded portion 72.

The plug receiving portion 15 of the upper row 5 is essentially a mirror image of the plug receiving portion 13 of the lower row 3, whereby a comb portion 86 and slot 87 receive the upper insert 70 providing correct positioning of the spring contacts 10. The upper insert 70, however, is of a different design than the lower inserts 68 in order to interconnect the plug contact portions 9 to the PCB contact portions 14 for contact to the printed circuit board, whereby the known lower inserts 68 cannot be used.

The upper insert assembly 70, comprises a first over-moulded portion 88 and a second over-moulded portion 90 extending essentially at 90° to the first over-moulded portion 88, whereby the first and second over-moulded portions 88, 90 of the upper inserts 70 are longer than the over-moulded portions 72, 74 of the lower inserts 68 such that the upper inserts 70 can be fitted thereover as shown in FIG. 3. The first over-moulded portion 88 of the upper insert 70 comprises lateral walls 92 having latching protrusions thereon for cooperation with the resilient latching members 77 in the upper cavities 66 of the housing 6 for securely fixing the inserts 70 therein.

Figure 7:
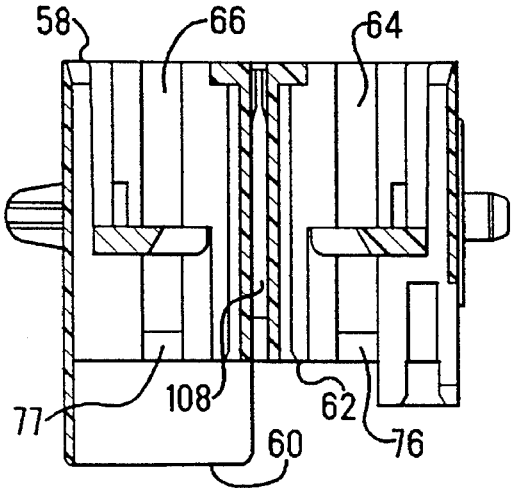
FIG. 7 is a cross-sectional view through lines 7—7 of FIG. 4.

Referring to FIG. 3 and FIGS. 16–18, a mid-shield 92 is shown positioned between the lower and upper inserts 68, 70 for reducing cross-talk interference therebetween. The mid-shield 92 comprises first plate portions 94 received in the slot 56 between the mid-walls 52, 54 of the housing 6, and extending perpendicularly therefrom a second plate portion 96 positioned between second over-moulded portions 74, 90 of the lower and upper inserts 68, 70 respectively. Extending orthogonally from the second plate portion at ends thereof, are small side walls 98 comprising grounding tabs 100 that extend below a lower end 102 thereof for electrical connection with the grounding circuit on the PCB. First plate portions 94 are separated by slots 104 to accommodate structural wall portions 108 of the housing 6 (see FIGS. 4 and 7) that extend between the mid-walls 52, 54. The mid-shield 92 as well as the front and rear shields 18, 19 are spaced sufficiently, e.g. 3 mm, from the terminals 10 to avoid "flashover" therebetween i.e. the passage of electrical current through the air or dielectric housing due to high potential differences between the terminals and ground. Similarly, the grounding tabs 36, 40, 100 are also positioned in a spaced manner from the PCB contact portions 14 of the terminals 10 by disposing the tabs on the sidewalls 34, 28, 98 of the shielding members 18, 90, 92 respectively.

Assembly of the connector is effectuated by first mounting the lower inserts 68 into the lower housing cavities 64 until they are fully latched into position by cooperation of the resilient latches 78 with the latch protrusions 76. The mid-shield 92 is then assembled to the housing 6 by inserting the first plate portions 94 into the slots 56 between the mid-walls 52, 54 until the second plate portions 96 of the mid-shield abut the rear face 62 of the main housing 6. The upper inserts 70 can then be inserted into the corresponding cavities by cooperation of the first over-moulded portions 88 in the slots 87 until the latching means 92, 76 engage. The external front shield member 18 can then be positioned over the front face 58 and the rear shield member 19 inserted over the rear face 60 until the latching cavities 23 thereof engage with the latching projections 26 of a front shield member 18 for securely locking the shield members together. The contact assemblies 68 and 70 are thereby well shielded from the exterior and also shielded from cross-talk interference between adjacent rows 3 and 5.

Besides doubling the number of ports without increasing the length, disposing the plug receiving portions 11, 12 in mirror image symmetry procures several other advantages. The first advantage, is that the back-to-back relationship provides good accessibility for releasing the resilient latch of the complementary modular plugs which engage with the modular jack latching sections 24 proximate the external lower and upper sides 16, 27. Furthermore, the upper insert 70 can be made smaller, and therefore using less material, as the over-moulded portions 88, 90 are positioned as close as possible (and therefore also the terminals) to the lower insert assembly 68. This would not be the case if the upper row 5 was disposed in the same manner as the lower row 3, whereby the first over-moulded insert 88 would be adjacent the housing top wall 48, and therefore have greater dimensions.

Advantageously therefore, the concept as described above is compact, simple to assemble, well shielded not only from external influences but also from internal cross-talk between adjacent rows of modular jacks, and in particular provides a large number of ports for mounting to a printed circuit board in a compact disposition whilst nevertheless providing good access to the plugging and unplugging of complementary modular plugs therewith.

We claim:

1. An electrical connector assembly for mounting on a printed circuit board (PCB), comprising a plurality of receptacle connectors, and a common main housing, each receptacle connector having an insert comprising a plurality of juxtaposed terminals mounted in an insulative portion thereof, the terminals each comprising a plug contact portion and printed circuit board contact portion extending at approximately 90° therefrom, the receptacle connectors securely mountable in the common main housing, the assembly characterized in that the receptacle connectors each have printed circuit board mounting sections, and plug receiving sections for mating with substantially identical complementary plug connectors, the receptacle connectors arranged in an upper row and a lower row such that the plug receiving sections of the upper and lower rows are in a substantially mirror-image disposition relative to a line between the upper and lower rows, whereby the rows are substantially parallel to the PCB when the connector assembly is assembled thereto.

2. The connector assembly of claim 1 characterized in that an electrically conductive mid-shield is positioned between the rows for suppressing cross-talk therebetween.

3. The connector assembly of claim 1 characterized in that the plug receiving sections are arranged such that latching means of the plug connectors for secure fixing thereof to the receptacle connectors are easily accessible from opposed lower and upper sides of the connector assembly, the lower side being adjacent the PCB.

4. The connector of claim 1 characterized in that the inserts of the upper row are mounted over the inserts of the lower row such that their respective plug receiving portions are disposed substantially in a back-to-back relationship and their respective PCB contact portions are disposed substantially in parallel.

5. The connector assembly of claim 3 characterized in that the mid-shield is L-shaped such that shielding is provided between upper and lower rows between plug receiving portions and also PCB mounting portions.

6. The connector assembly of claim 5 characterized in that the mid-shield has tabs projecting from sidewalls thereof below a lower side of the connector assembly towards the PCB for electrically contacting ground circuit traces thereon, the sidewalls flanking either end of the rows of modular jacks.

7. The connector assembly of claim 1 characterized in that exterior shielding is provided around the exterior of the connector assembly, a front shield member mountable over a front side of the connector assembly and having holes therein aligned with the plug receiving portions of the receptacle connectors for receiving the mating plug connectors therethrough.

8. The connector assembly of claim 7 characterized in that the exterior shielding comprises a rear shield member securable to the front shield member, the rear shield member mountable over a rear side of the connector assembly opposed to the front side.

9. The connector assembly of claim 8 characterized in that the front and rear shield members have overlapping portions comprising complementary latching means thereon.

10. The connector assembly of any preceding claims characterized in that the exterior shielding has tabs extending from sidewalls of the shield members below the lower end of the connector assembly for electrically contacting ground circuit traces on the PCB, the sidewalls flanking either end of the rows of modular jacks.

11. The connector of any one of the claims 1–9 characterized in that the common main housing is integral.

* * * * *